US007464926B2

(12) United States Patent
Moore et al.

(10) Patent No.: US 7,464,926 B2
(45) Date of Patent: Dec. 16, 2008

(54) SHEET CURL CORRECTION METHOD AND FEEDER APPARATUS

(75) Inventors: Kenneth P. Moore, Rochester, NY (US); Aldwin A. Roberts, Macedon, NY (US); Brian R. Ford, Walworth, NY (US); Lawrence D. Dipzinski, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 122 days.

(21) Appl. No.: 11/614,937

(22) Filed: Dec. 21, 2006

(65) Prior Publication Data

US 2007/0102870 A1 May 10, 2007

Related U.S. Application Data

(62) Division of application No. 10/889,669, filed on Jul. 13, 2004, now Pat. No. 7,267,337.

(60) Provisional application No. 60/525,051, filed on Nov. 25, 2003.

(51) Int. Cl.
*B65H 1/08* (2006.01)

(52) U.S. Cl. ..... 271/148; 271/152; 271/153; 271/154; 271/155

(58) Field of Classification Search ..... 271/148, 271/152, 153, 154, 155, 30.1, 31
See application file for complete search history.

(56) References Cited

U.S. PATENT DOCUMENTS

| | | | | |
|---|---|---|---|---|
| 3,716,226 | A | 2/1973 | Kistner | 271/31 |
| 6,186,492 | B1 | 2/2001 | Dechau et al. | |
| 6,247,695 | B1 | 6/2001 | Linder et al. | |
| 6,290,225 | B1 | 9/2001 | Linder et al. | 271/155 |
| 6,460,846 | B2 | 10/2002 | Yow et al. | |
| 6,609,708 | B2 | 8/2003 | Moore et al. | |
| 2002/0005610 | A1 | 1/2002 | Moore et al. | 271/11 |

FOREIGN PATENT DOCUMENTS

| | | |
|---|---|---|
| GB | 2267081 | 11/1993 |
| JP | 10-1231 | 1/1998 |

*Primary Examiner*—Patrick H Mackey
*Assistant Examiner*—Thomas A Morrison
(74) *Attorney, Agent, or Firm*—Joseph M. Young

(57) ABSTRACT

A pneumatic sheet feeder is selectively actuable to acquire a sheet from a stack and transport the sheet towards a take-away nip. The feeder includes a feedhead having an acquisition surface substantially aligned with the take-away nip. A sensing apparatus detects three separate distances between the stack and the acquisition surface at three separate locations over the stack. The stack is then tilted based upon the distances sensed by the sensors. In embodiments, the feedhead has two sensors, and moves so that the third distance can be measured by one of the sensors. In other embodiments, the feedhead includes three sensors for measuring each of the distances.

5 Claims, 8 Drawing Sheets

SHEET CURL CORRECTION METHOD AND FEEDER APPARATUS

This is a divisional application of U.S. application Ser. No. 10/889,669, filed Jul. 13, 2004, now U.S. Pat. No. 7,267,337 by the same inventors, entitled "SHEET CURL CORRECTION METHOD AND FEEDER APPARATUS," which claims the benefit of Provisional Patent Application No. 60/525,051, filed Nov. 25, 2003.

The embodiments disclosed herein relate generally to a high capacity feeder for an electrophotographic printing machine and, more particularly, concerns a vacuum corrugation shuttle feed head for the feeder.

In single pass color machines and other high speed printers, it is desirable to feed a wide variety of media for printing thereon. A large latitude of sheet sizes and sheet weights, in addition to various coated stock and other specialty papers must be fed at high speed to the printer.

The following patents describe in detail a vacuum corrugated shuttle feed device for use with high speed printers: U.S. Pat. Nos. 6,186,492, 6,247,695, 6,460,846, and 6,609,708 hereby incorporated by reference in their entirety.

U.S. Pat. No. 6,609,708, for example, discusses curl correction, wherein the angle of a stack of sheets is adjusted relative to a vacuum shuttle feed device to account for curl in the sheets so that the sheets are fed properly. However, the correction process described therein does not account for concentrated "hook" curl at the LE of the stack.

Embodiments include a method for correcting sheet curl in a paper feeder having a tiltable tray. The method includes detecting a first distance above a surface of a stack of sheets on the tiltable tray to be fed into a printing device at a first location above the stack of sheets; detecting a second distance above the surface of the stack of sheets on the tiltable tray to be fed into the printing device at a second location above the stack; and detecting a third distance above the surface of the stack of sheets to be fed into the printing device at a third location above the stack. The third location is nearer to a lead edge of the stack than the first or second locations. The tray then tilts based upon the first, second, and third distances detected.

Embodiments also include a pneumatic sheet feeder being selectively actuable to acquire a sheet from a stack and transport the sheet towards a take-away nip, the sheet feeder. The feeder includes a feedhead having an acquisition surface, the acquisition surface being substantially aligned with the take-away nip. The feeder also includes a stack height sensor for detecting a first distance between a stack of sheets and the acquisition surface at a first location over the stack of sheets. The feeder also includes a lead edge attitude sensor for detecting a second distance between the stack of sheets and the acquisition surface at a second location closer to a lead edge of the stack of sheets than the first location. The feedhead is moveable, such that the second sensor also detects a third distance between the stack of sheets and the acquisition surface at a third location closer to the lead edge of the stack of sheets than the second location.

Various exemplary embodiments will be described in detail, with reference to the following figures, wherein.

Figure 6:
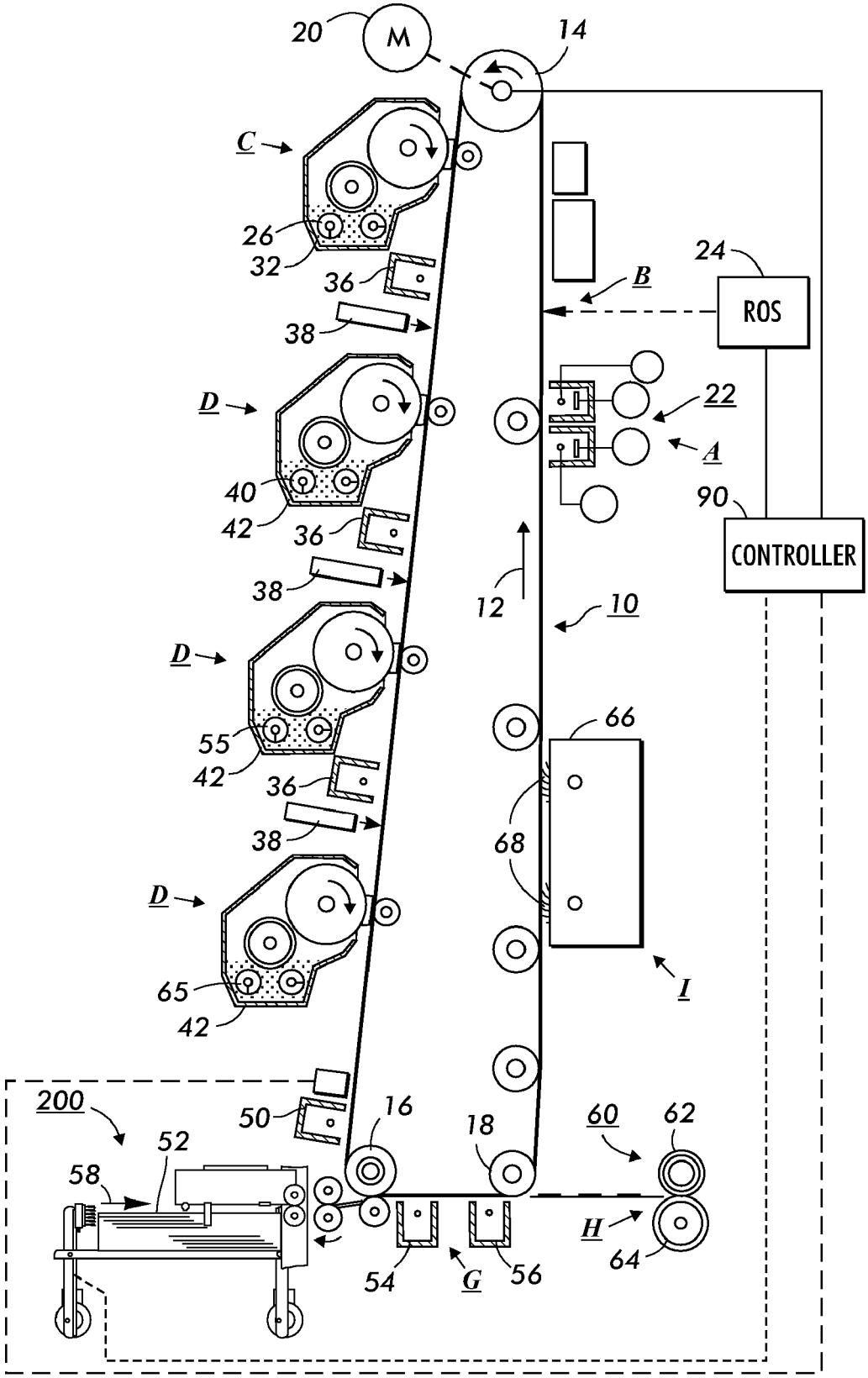
FIG. 6 is a schematic elevational view of a full color image-on-image single-pass electrophotographic printing machine using the device described herein
Figure 7:
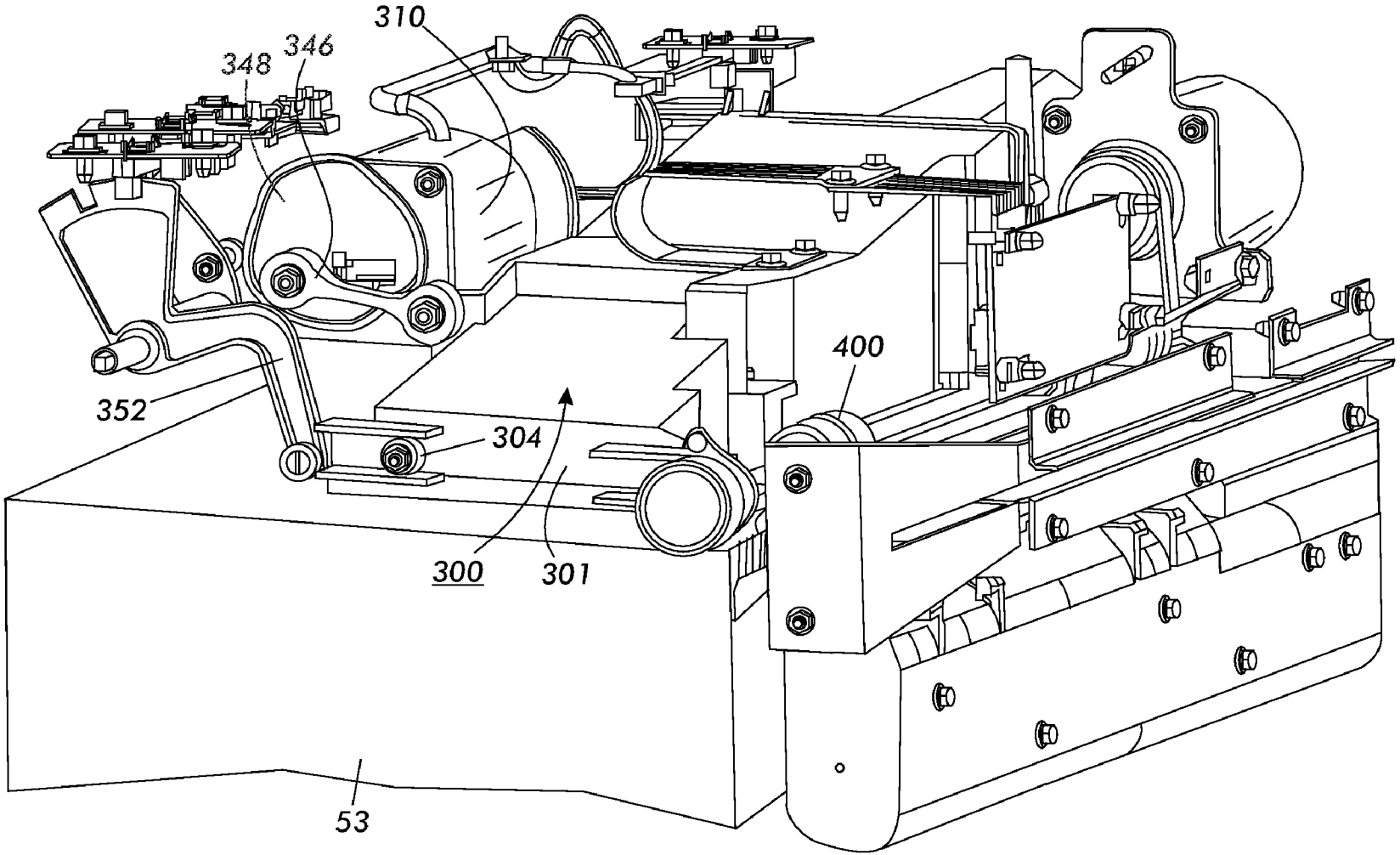
FIG. 7 is a perspective view of the shuttle feedhead and dual flag stack height sensor.
Figure 8:
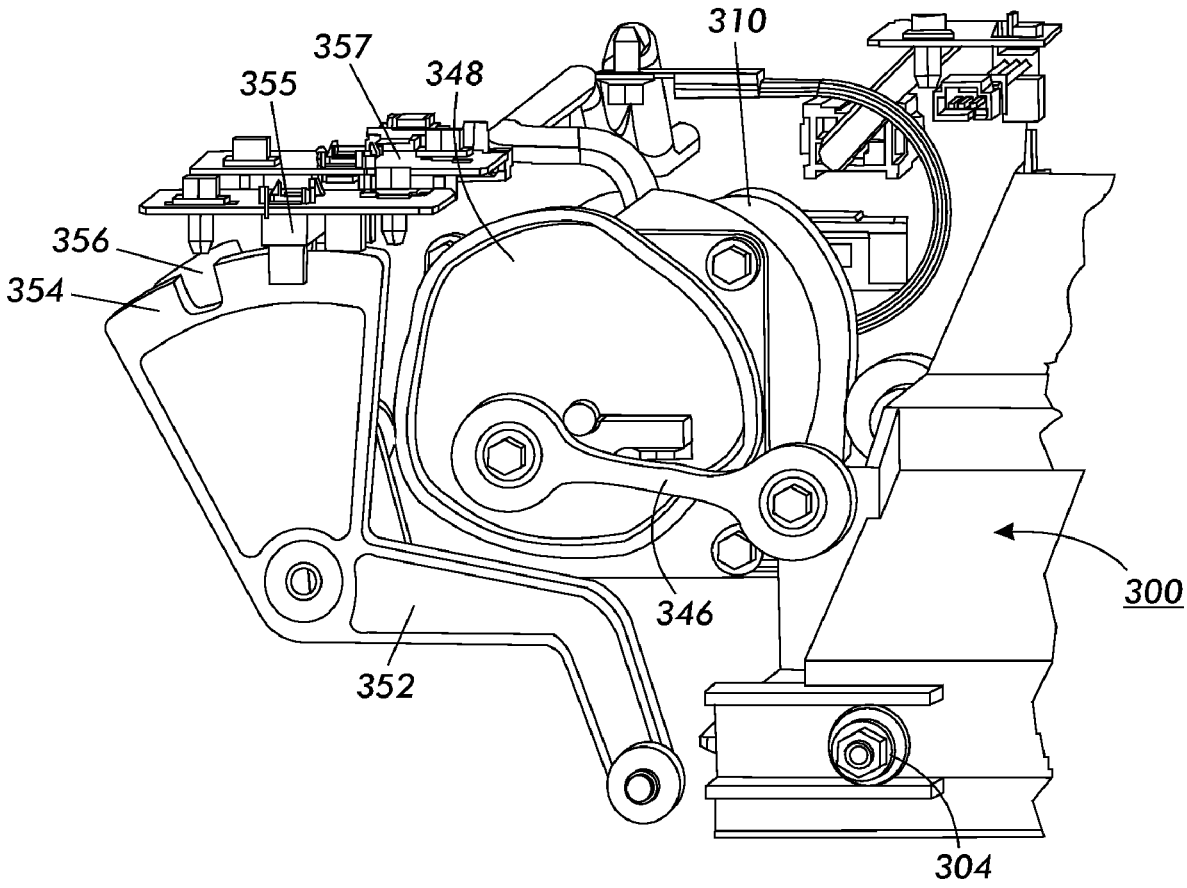
FIG. 8 is a detailed perspective of the actuator for the dual flag stack height sensor.

FIG. 6 shows a printing machine using a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension rollers 16 and fixed roller 18 and the roller 14 is operatively connected to a drive motor 20 for effecting movement of the belt through the xerographic stations.

With continued reference to FIG. 6, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller 90 receives the image signals representing the desired output image and processes these signals to convert them to the various color separations of the image to be reproduced. The color separations are then transmitted to a laser based output scanning device 24 causing the charge retentive surface to be discharged in accordance with the output from the scanning device. Preferably the scanning device is a laser Raster Output Scanner (ROS). Alternatively, other xerographic exposure devices such as LED arrays could replace the ROS.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C, developer structure indicated generally by the reference numeral 32 using a hybrid jumping development (HJD) system, the development roll, better known as the donor roll, is powered by two development fields (potentials across an air gap). The first field is the ac jumping field, which is used for toner cloud generation. The second field is the dc development field, which is used to control the amount of developed toner mass on the photoreceptor. The toner cloud causes charged toner particles 26 to be attracted to the electrostatic latent image. Appropriate developer biasing is accomplished via a power supply. This type of system is a noncontact type in which only toner particles (black, for example) are attracted to the latent image and there is no mechanical contact between the photoreceptor and a toner delivery device to disturb a previously developed, but unfixed, image.

The developed but unfixed image is then transported past a second charging device 36 where the photoreceptor and previously developed toner image areas are recharged to a predetermined level.

A second exposure/imaging is performed by device 38 which comprises a laser based output structure is used for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas that are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third image for a third suitable color toner such as magenta and for a fourth image and suitable color toner such as cyan. The exposure control scheme described below may be used for these subsequent imaging steps. In this manner a full color composite toner image is developed on the photoreceptor belt.

Since some toner charge may not be totally neutralized, or the polarity thereof may be reversed, (thereby causing the composite image developed on the photoreceptor to consist of both positive and negative toner), a negative pre-transfer dicorotron member 50 is provided for conditioning the composite image in order to facilitate its effective transfer to a substrate.

Subsequent to image development a sheet of support material 52 is moved into contact with the toner images at transfer station G. The sheet of support material is advanced to transfer station G by the sheet feeding apparatus described in detail below. The sheet of support material is then brought into contact with photoconductive surface of belt 10 in a timed sequence so that the toner powder image developed thereon contacts the advancing sheet of support material at transfer station G.

Transfer station G includes a transfer dicorotron 54, which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) that advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to a catch tray, stacker, finisher or other output device (not shown), for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush or plural brush structure contained in a housing 66. The cleaning brush 68 or brushes 68 are engaged after the composite toner image is transferred to a sheet. Once the photoreceptor is cleaned the brushes are retracted using a device 70.

It is believed that the foregoing description is sufficient for the purposes of the present application to illustrate the general operation of a color printing machine.

It is desirable in high speed color printers such as those described above to be able to feed a wide variety of sheet types for various printing jobs. Customers demand multiple sized stock, a wide range of paper weights, and paper appearance characteristics ranging from rough flat appearing sheets to very high gloss coated paper stock. Each of these sheet types and size has its own unique characteristics and in many instances very different problems associated therewith to accomplish high speed feeding.

Figure 1:
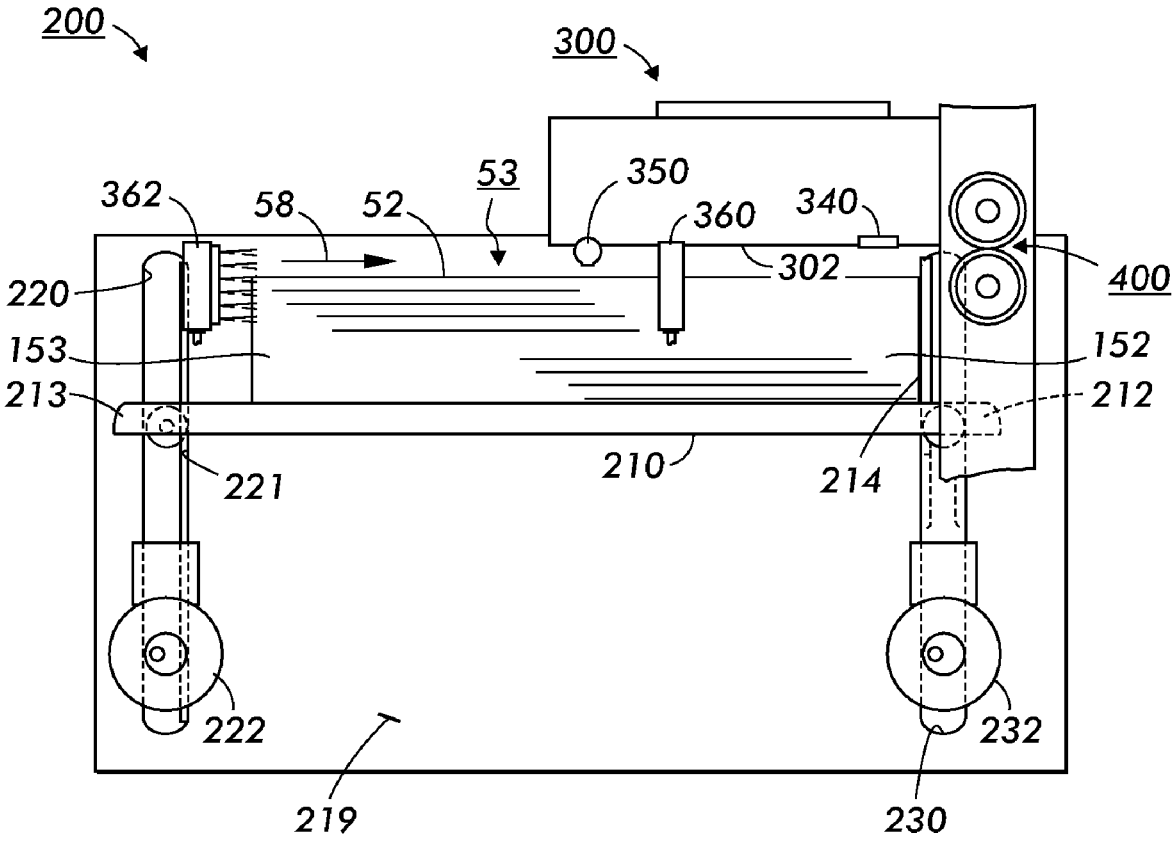
FIG. 1 is a schematic side view of a first exemplary embodiment of a feeder apparatus in a first position.

FIG. 1 schematically shows a side elevational view of a tiltable paper tray or feeder 200. As shown, the paper tray or feeder 200 includes a sheet support tray 210 that is tiltable and self adjusting in order to accommodate the characteristics of various sheet types. The feeder 200 also includes multiple tray elevator slots 220, 230 defined by side frames 219 (only one of which is shown), and elevator drives 222, 232 for raising, lowering and tilting a stack 53 of sheets supported on the tray 210. The feeder 200 also includes sheet fluffers 360, 362. The feeder also includes a top vacuum corrugation feeder (VCF) feedhead 300. Finally, the feeder 200 includes a variable acceleration take away roll (TAR) 400.

Paper characteristics such as dimensions (process and cross-process), and weight (gsm) will be loaded into the print station controller by the operator or determined automatically by sensors in the machine. To tailor the module's control factor settings to the paper being run, the feeder module uses the previously mentioned characteristics. To compensate for variation in paper characteristics, the paper tray 210 in the feeder module uses two independent motors 222, 232 to position the lead edge 152 of a stack 53 within a prescribed range. The range in which the stack lead edge 152 is positioned is determined by weight, based on the failure modes typically associated with the paper. For example, heavy weight papers are typically more difficult to acquire than lightweight papers, therefore, the range for heavy weight papers is closer to the feedhead 300 than the lightweight range. Lightweight papers, which typically are more prone to multifeed, are set up in a range which is further from the feedhead, thus preventing sheets from being dragged into the take away roll by sheet to sheet friction. This angling tray enables the feeder module to achieve these desired ranges even when the paper is curled in the process direction.

The vacuum corrugation feeder (VCF) feedhead 300 delivers each sheet to the TAR 400. Proper feeding with a top VCF feedhead 300 requires correct distance control of the top sheets in the stack 53 from the acquisition surface 302 and fluffer jets 360. The acquisition surface 302 is the functional surface on the feed head 300 or vacuum plenum. A system of sensors is employed to maintain the appropriate distance between the top of the stack and the acquisition surface.

Figure 2:
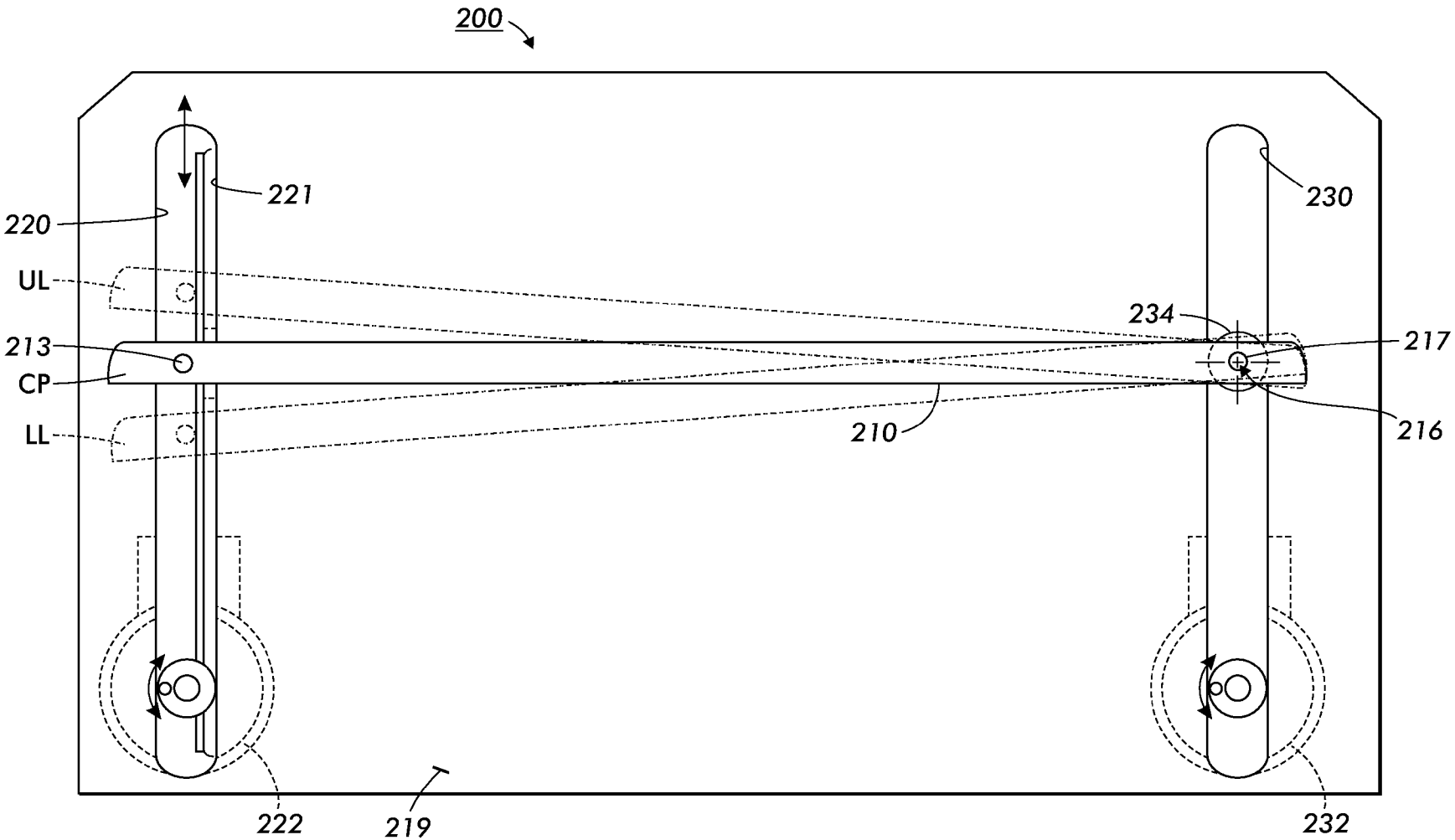
FIG. 2 is a side view of the elevator drives for the feeder apparatus.

By using a combination of sensors in the feedhead to detect proximity of the sheet stack, which can reflect the curl, the elevator is sent a signal to compensate for curl. Depending on the state of curl the elevator may be tilted up or down for downcurl/upcurl, respectively. See FIG. 2. Tilting up to compensate for down curl will be limited to a maximum to prevent a large gap between the LE 152 of the paper and the LE registration wall 214.

For example, after the paper 53 is loaded, the tray 210 will raise to stack height. Subsequently, a sequence of events takes place to determine the initial amount of compensation necessary for the stack. The tray 210 would then be tilted so that the stack leading edge 152 is higher or lower than the stack trailing edge 153 depending on whether there is down-curl or up-curl in the sheets in the stack 53 thereon. This tilting of the tray 210 brings the leading edge 152 (LE) of the top sheets of the stack 53 into proper location relative to the acquisition surface 302 of the feed head 300 and the fluffing jets. In order to institute the corrective tilting action, the height of the top sheet 52 near its leading edge 152 must be sensed, relative to the feed head 300, prior to acquisition and with the air system on and the stack "fluffed".

For example, if the paper is loaded in a flat tray and the tray 210 has to compensate for downcurl, the LE of the stack could be tilted up. By tilting up after the paper is loaded, the LE 152 of the stack 53 is pulled away from the LE registration wall 214. Therefore, it is desirable to have an initial degree of tilt in the tray 210. The tray 210 is initially tilted up on the LE 152 side, approximately 1.4° when paper is loaded. The initial angle is set at the maximum allowable angle while still maintaining stack capacity.

In embodiments, the tray 210 intentionally starts out with a slight uptilt. In such cases, the tray may only need to be tilted lower and not higher.

In embodiments, the feeder 200 includes a lead edge multiple range leading edge attitude (LEA) sensor 340 (reflective sensor) and a multiple position stack height sensor 350. The LEA sensor 340 can detect four or more specific stack heights and the multi-position stack height (contact) sensor 350 can detect two or more specific stack heights. Stack height is defined as the distance from the top of the stack to the acquisition surface 302. The two sensors together enable the paper supply to position the stack 53 with respect to the acquisition surface 302 both vertically and angularly in the process direction. The tray is tilted depending upon the relative distances between the acquisition surface and the top of the stack of sheets. This height and attitude control greatly improves the capability of the feeder to cope with a wide range of paper basis weight, type, and curl.

The angle of the paper supply tray is set up using the stack height sensor and the LEA sensor. Each of these sensors measures the location of the top of the paper stack. In the preferred embodiment, the stack height sensor is actually a pair of transmissive sensors and preferably indicate a 10,12.5, 15, >15 mm stack height. The LEA sensor is an infrared LED with 4 detectors which is used to determine the location of the stack lead edge within a range of 0-3, 3-6, 6-9 or >9 mm from the feedhead. In the current application, the 0-3 mm range is used to measure sheet acquisition time. This is accomplished by measuring the time from vacuum valve "open" signal until the 0-3 range is detected, indicating sheet acquisition. The desired stack height and lead edge position are determined by user input of the paper weight in gsm. The combinations of these sensors will indicate when the stack is in any of the following conditions:

TABLE 1

| Stack Height: | Lead Edge Range: | Control Algorithm Response: |
|---|---|---|
| Too Low | Too Low | Raise tray maintaining current angle until either desired Stack Height or desired Lead Edge position are reached |
| Too Low | Correct | Raise tray only at Trail Edge until Stack Height is reached |
| Too Low | Too High | Raise tray only at Trail Edge until Stack Height is reached |
| Correct | Too Low | Pivot tray counter clockwise around Stack Height measurement location until desired Lead Edge position is reached. |
| Correct | Correct | No response required |
| Correct | Too High | Pivot tray clockwise around Stack Height measurement location until desired Lead Edge position is reached. |

The process illustrated in the table above is as follows:

Loading: When tray empty is reached, the tray lowers and is leveled when it reaches the lower limit sensors (not shown) for the lead and trail edge of the tray 210. At this point the lead edge of the tray is raised to approximately 1.4 degrees before the latch is released for paper loading.

Initial Angle & Lift: Once the operator loads the tray, the tray raises until the transition which indicates the lowest stack position at the stack height sensor or the LEA sensor occurs. At this point, the air system is turned on so that a measurement of the lead edge position of the fluffed stack can be taken.

The possible conditions once the air system is turned on & lead edge measurement is taken are as follows:

A) Stack Height is Correct —Lead Edge is Correct: In this condition no further set up of the tray is required. Wait for feed signal.

B) Stack Height is Correct —Lead Edge is Too Low: Tray will rotate counter clockwise about stack height measurement point until the lead edge is in the correct state. This is achieved by driving the stepper motors at lead and trail edge in opposite directions at a speed ratio defined by the distance of the lift points from the stack height measurement point. Note this condition could result in misregistration of stack lead edge (See "loading"under fault prevention section below).

C) Stack Height is Correct —Lead Edge is Too High: Tray will rotate clockwise about stack height measurement point until the lead edge is in the correct state. This is achieved by driving the stepper motors at lead and trail edge in opposite directions at a speed ratio defined by the distance of the lift points from the stack height measurement point.

D) Stack Height is Too Low —Lead Edge is Correct or Too High: Raise trail edge only until stack height is achieved. Measure location of lead edge and execute A), B), or C) as required.

E) Stack Height is Too Low —Lead Edge is Too Low: Raise tray, maintaining current angle until correct stack height or lead edge state is reached. Measure location of lead edge and execute A), B), or C) as required. NOTE: Since the tray is initially raised only until the lowest lead edge state or stack height is reached, a condition in which the stack height reached is too high should only occur as a result of a stack height sensor failure or a customer loading the tray above the maximum fill line.

There are also various Fault Prevention Measures which are incorporated into the system:

Loading: The reason for the initial "loading angle" is to minimize conditions in which the lead edge of the stack would be too low during tray setup. If stack height has already been achieved, this lead edge low condition results in the tray being rotated counter clockwise and could result in the top of the stack moving away from the registration edge at the lead edge of the paper supply. By loading the tray with the lead edge up the tray will, in most cases, rotate such that the stack lead edge will be driven into the lead edge registration wall.

Initial Angle & Lift: Because the stack is fluffed during setup, it is important to avoid lifting the lead edge of the stack above the top of the lead edge registration wall. If the sheet floats over the top of the wall it could result in an incorrect setting of the position of the stack lead edge and skewed sheet feeding. The lead edge sensor may detect that lead edge is too close to the feedhead and as a result, drop lead edge. Since the lead edge is resting on the reg. wall, it will not drop away and the tray will rotate to its limit. In order to prevent this from occurring, before the air system is turned on, the angle in the tray is reduced depending on the weight of the paper (high, medium, or low), in the tray. The degree to which the tray angle is leveled was determined based on the final angle typically reached after tray set up was completed. For example, because the lead edge of lightweight paper typically fluffs higher than heavier weights, and this results in the tray angle being 0 degrees or less (negative angle indicating lead edge is lower than trail edge) after loading, the tray levels before the air system turns on and the set up process begins.

The set up process incorporates routines to prevent or detect faults such as excessive angling of the tray, tray over travel or failures to move the tray.

During each feed, when the trail edge 153 of the sheet being fed passes the stack height arm 352, the arm compresses the stack 53, the stack height sensors measure the position of the solid stack, and the stack height arm 352 is raised again. Once the trail edge 153 of the sheet 52 passes the position of the LEA sensor 340, the position of the lead edge 152 of the fluffed stack 53 is measured. The values of these measurements are then compared to the desired states for the paper being fed and the tray is adjusted accordingly. Regardless of the state of the stack lead edge, when the stack height sensor indicates the stack is too low, the tray increments approximately 1 mm. The frequency of angular adjustment based on feedback from the LEA sensor 340 is based on the mode of the last few sheets recorded. For example, the lead edge gap measurement is recorded for 3 feeds, if the mode indicates the stack lead edge was not in the correct range most frequently, the tray angle is adjusted accordingly. The mode is used to avoid over compensation for individual sheets within the stack. For example, if a single sheet was not properly registered and has some edge damage or curl at the lead edge, we would not want to immediately shift the entire stack. Of course depending on the situation, more or less samples can be used to perform the dynamic adjustment.

Once the setup process is completed, the system then feeds sheets to the printer and compensates for variations in the stack as described above. The feedhead 300 is a top vacuum corrugation feeder (TVCF) shuttle which incorporates an injection molded plenum/feed head 301 with a sheet acquisition and corrugation surface 302. The feed head 300 is optimally supported at each corner by a ball bearing or other low friction roller 304. In the preferred embodiment, the feed head 300 is driven forward 20 mm and returned 20 mm back to home position by a continuous rotation and direction twin slider-crank drive 346 mounted on a double shaft stepper motor 310. This includes 5 mm overtravel to account for paper loading tolerance and misregistration. This drive results in a linear sheet speed of only about 430 mm/s as the sheet is handed off to the take away roll 400 (TAR). The TAR 400 is also stepper driven and accelerates the sheet up to transport speed. Since the stepper controls are variable in software, the feeder can feed from any minimum speed to a demonstrated PPM rate of 280 (for 8.5") for a wide range of paper type, basis weight, and size with no hardware changes.

The stack height sensor 350 measures the distance from the top of the stack 53 to the acquisition surface 302 . The stack height sensor 350 is situated near the outboard side of the feed head 300. In embodiments, it sits about 6 inches back from the stack LE 152. The purpose of this is to keep the stack height sensing near the fluffer jets 360, which are typically mounted on the inboard and outboard sides of the stack about 5 inches back from the LE 152. These measurements are not critical, except that it is desirable to have the sensor arm and the fluffer jets 360 in relatively close proximity. This insures that the top of the sheet stack will be well controlled with respect to the fluffer jets. During the sheet feed out process, after the feed head 300 hands off the sheet to the TAR 400, the feed head 300 delays in the forward position to allow the sheet 52*v* to feed to the point where the trail edge 153 (TE) iust passes the stack heiciht sensinci position. When the TE of the sheet reaches this point, the delay has already ended and the feed head 300 has returned to a point where a concentric (to feed head drive) cam 348 will drop the string loaded stack height sensing arm 352 onto the stack 53. This arm 352 rests on the stack for about 25 ms and software monitors the stack height zone. Then, as the feed head drive 346 continues, the cam 348 lifts the arm 352 from the stack 53 as the feed head 300 reaches its "home" position.

The LEA sensor 340 also measures the distance from the top of the stack 53, at the lead edge 152, to the acquisition surface 302 (referred to as range). The LEA sensor 340 is situated near the outboard side of the feed head 300. The LEA sensor is typically mounted on the vacuum plenum and flush with the feed surface. In embodiments, the LEA sensor 340 scans the stack from a distance of about 20 mm from the lead edge when the feedhead is in the home position.

However, when the feedhead is in the home position, the LEA sensor 340 is far enough back from the actual lead edge, that it does not see concentrated "hook" curl at the LE of the stack. If this kind of curl is present, the LEA sensor will not detect it from its home position. Therefore, the initial tilt setup will incorrectly setup the gap between the acquisition surface and the stack before the first sheet is fed. This could cause misfeeds or multifeeds in the top several sheets.

One method of fixing this problem is simply to take another reading closer to the actual stack LE 152. The distance measured between the acquisition surface 302 and the stack at the actual stack LE would be measured and compared with the distance measured between the acquisition surface 302 and the stack by the LEA sensor in its home position. The difference between these two heights would be factored into the initial tilt setup.

Two exemplary methods of obtaining this second reading include (1) moving the feedhead forward and taking a second initial measurement with the LEA sensor, and (2) adding a third sensor closer to the actual LE 152 of the top sheets of the stack.

Figure 3:
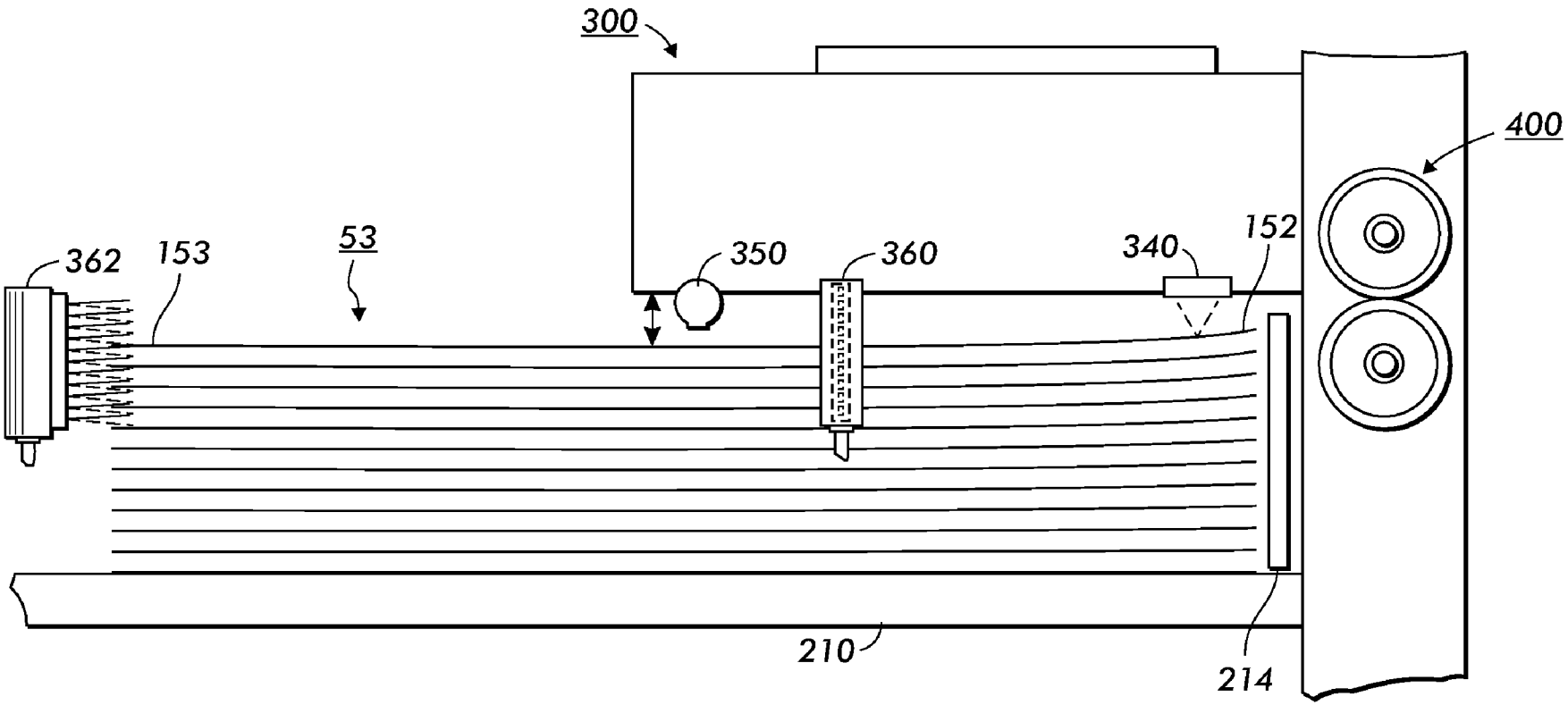
FIG. 3 is a more detailed schematic side view of the feeder apparatus in the first position.
Figure 4:
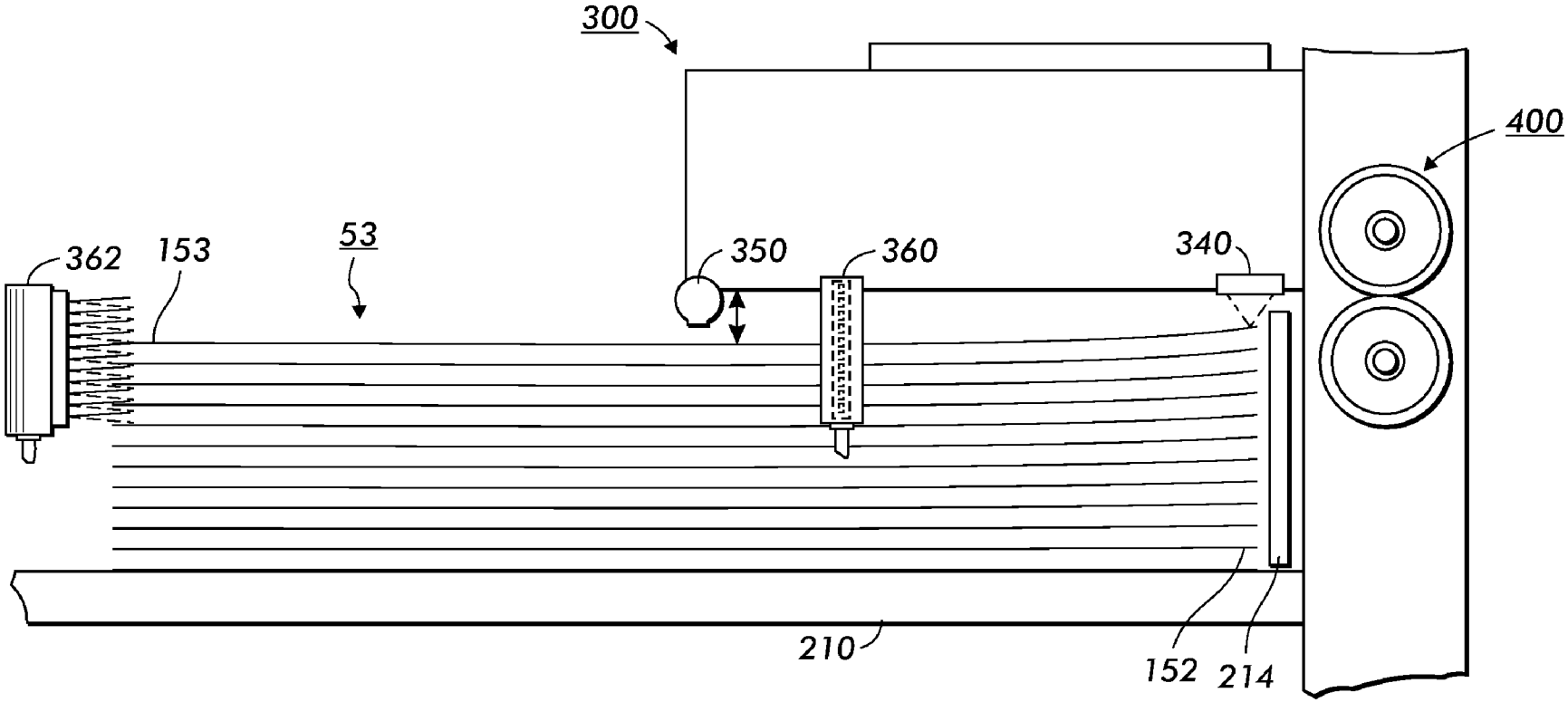
FIG. 4 is a more detailed schematic side view of the feeder apparatus in a second position.

Method one involves taking a LEA sensor 340 distance reading during an initial setup routine while the vacuum feed head is in its home position (see FIG. 3), before the air system turns on to set up tray tilt. The vacuum feed head is then moved to a service position and the LEA sensor 340 takes another reading (see FIG. 4). In embodiments, the service position is about 20 mm forward from the home position. This locates the LEA sensor approximately over the actual LE 152 of the paper stack 53 where "hook curl" would be detectable. In embodiments, the LEA sensor 340 is within 1 mm of being directly over the lead edge 152. After the second LEA sensor reading is taken, if a closer feed surface to stack gap distance is detected, then the LE tray motor will lower until it achieves the same feed surface to stack gap as at the home position. Once the zones are the same without exceeding a maximum tray step delta, the feed head will move back to the home position, the air system will activate, and the initial tilt setup will take place.

Figure 5:
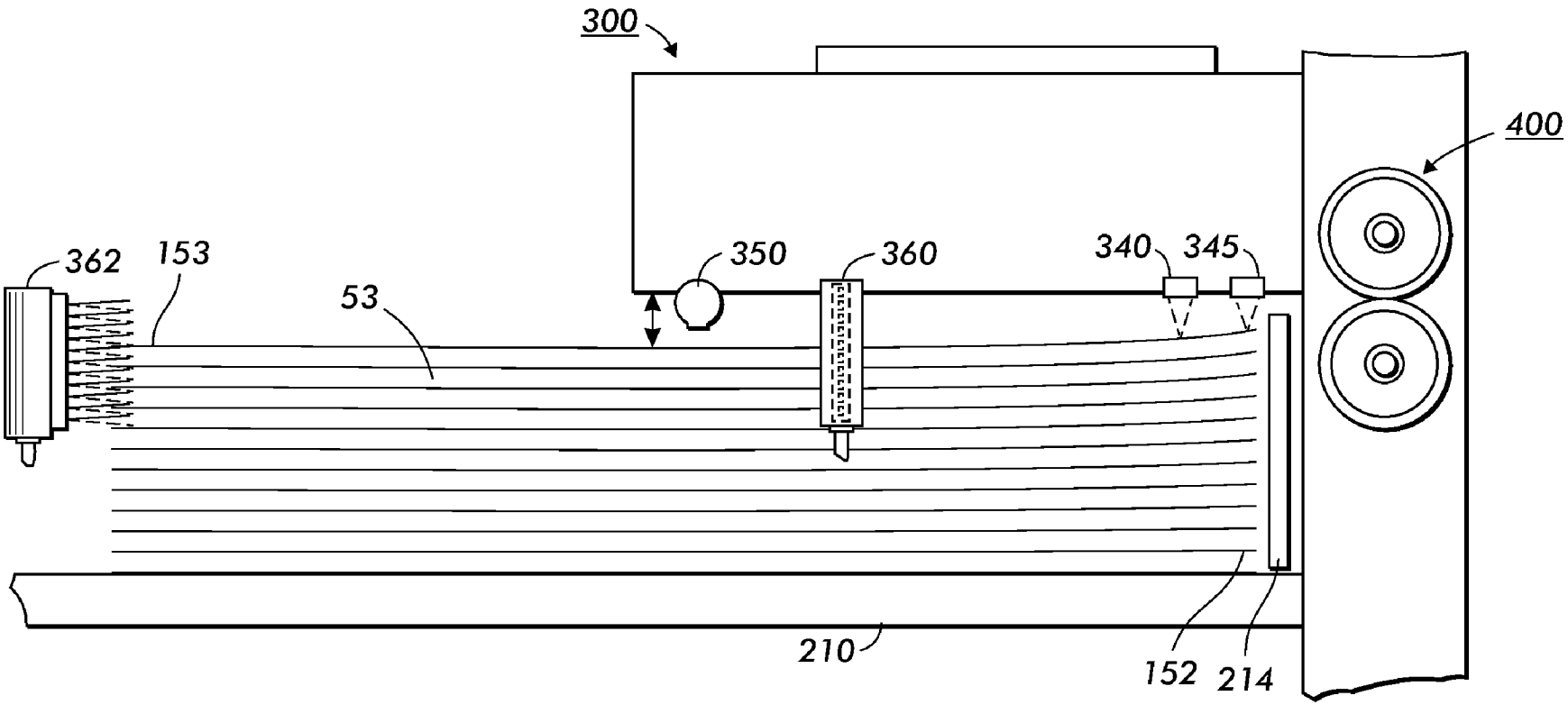
FIG. 5 is a more detailed schematic side view of another embodiment of a feeder apparatus in the first position.

Alternatively, the VCF feedhead 300 could be provided with a third sensor 345 as shown in FIG. 5. The third sensor 345 would be located approximately over the actual LE 152 of the stack 53. In embodiments, the third sensor 345 is within 1 mm of being directly over the lead edge 152. The current LEA sensor 340 would continue to take a reading approximately 20 mm from the LE 152 of the stack 53, when the feedhead 300 is in its home position. Here it, in conjunction with stack height sensor 350, would still continue to be used to determine gross curl in the sheet stack. However, the new LE sensor 345 would detect the height of the LE 152 of the stack 53, and compare this value to the distance measurement taken by the LEA sensor to determine the level of edge curl and adjust the attitude control appropriately.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A sheet feeding apparatus, comprising:

a pneumatic feedhead being selectively actuable to acquire a sheet from a stack and transport the sheet towards a take-away nip, the feed head having an acquisition surface, the acquisition surface being substantially aligned with the take-away nip, a stack height sensor for detecting a first distance between a stack of sheets and the acquisition surface at a first location over the stack of sheets, a lead edge attitude sensor for detecting a second distance between the stack of sheets and the acquisition surface at a second location closer to a lead edge of the stack of sheets than the first location, and also for detecting a third distance between the stack of sheets and the acquisition surface at a third location closer to the lead edge of the stack of sheets than the second location;

a first motor for moving the feedhead, so that the lead edge attitude sensor can measure the second distance and the third distance at the second and third locations, respectively, a sheet support tray; and a second motor that adjusts the tray based upon the first, second, and third distances detected.

2. The sheet feeding apparatus of claim 1 wherein the third location is not more than 1 mm from the lead edge of the stack.

3. The sheet feeding apparatus of claim 1 wherein the second motor adjusts the tray by doing at least one of raising the tray, lowering the tray, or tilting the tray.

4. The sheet feeding apparatus of claim 1, further comprising a third motor that also contributes to adjusting the tray based upon the first, second, and third distances detected.

5. The sheet feeding apparatus of claim 4, wherein the third motor adjusts the tray by doing at least one of raising the tray, lowering the tray, or tilting the tray.

* * * * *